US007568238B2

(12) United States Patent
Schossberger et al.

(10) Patent No.: US 7,568,238 B2
(45) Date of Patent: Aug. 4, 2009

(54) WRIST COVERING AND METHOD OF MAKING THE SAME

(75) Inventors: Peter F. V. Schossberger, Pocatelio, ID (US); Steven F. Schossberger, Boise, ID (US)

(73) Assignee: Wrist-Gator LLC, Boise, ID (US)

( * ) Notice: Subject to any disclaimer, the term of this patent is extended or adjusted under 35 U.S.C. 154(b) by 0 days.

(21) Appl. No.: 11/695,531

(22) Filed: Apr. 2, 2007

(65) Prior Publication Data

US 2008/0235846 A1 Oct. 2, 2008

(51) Int. Cl.
*A41D 27/12* (2006.01)

(52) U.S. Cl. ..... 2/59; 2/162

(58) Field of Classification Search ..... 2/16, 2/20, 59, 62, 162, 170; 128/878; 602/21
See application file for complete search history.

(56) References Cited

U.S. PATENT DOCUMENTS 2,904,792 A * 9/1959 Elliott ..... 2/16
4,287,608 A 9/1981 Meyer
4,531,241 A * 7/1985 Berger ..... 2/161.2
4,733,412 A 3/1988 Campbell
4,854,309 A * 8/1989 Elsey ..... 602/21
4,856,112 A 8/1989 Effle
5,173,967 A * 12/1992 Carter ..... 2/242
5,375,263 A 12/1994 Cuccia
5,445,566 A * 8/1995 Hayes ..... 473/62
5,542,121 A 8/1996 Lahaussois et al.
5,628,062 A 5/1997 Tseng
5,737,771 A * 4/1998 Aanonsen ..... 2/16
5,864,886 A 2/1999 Gregory, et al.
5,873,130 A 2/1999 Lafferty
5,878,435 A 3/1999 Kast et al.
5,898,936 A 5/1999 Janes (Continued)

FOREIGN PATENT DOCUMENTS

GB 287546 5/1928

OTHER PUBLICATIONS http://en.wikipedia.org/wiki/Gore-Tex.
http://www.gore.com/en_xx/products/consumer/goretex/index.html.

*Primary Examiner*—Katherine Moran
(74) *Attorney, Agent, or Firm*—Zarian Midgley & Johnson PLLC

(57) ABSTRACT

The present application is directed to a wrist covering designed to be worn over the gloved hand and arm-sleeve of a user. The wrist covering comprises a flexible, generally tubular member extending from a first opening, designed to fit around the forearm of the user, to a second opening, designed to fit around the hand of the user. The first opening has a larger circumference than the second opening. The wrist covering further includes a thumb aperture in the tubular member proximate to the second opening. A first fastener is positioned on the tubular member in a manner that allows tightening of the tubular member around the user's hand. A second fastener is positioned on the tubular member in a manner that allows tightening of the tubular member around the user's wrist. A third fastener is positioned on the tubular member in a manner that allows tightening of the tubular member around the user's forearm. A method of making the wrist covering is also disclosed.

14 Claims, 5 Drawing Sheets

U.S. PATENT DOCUMENTS 6,092,235 A * 7/2000 Santa Cruz et al. ..... 2/16
6,363,534 B1 4/2002 Clough
6,398,748 B1 * 6/2002 Wilson ..... 602/21
6,449,772 B1 9/2002 Donner
7,135,007 B2 * 11/2006 Scott et al. ..... 602/75
7,200,872 B2 * 4/2007 Gregory ..... 2/170

* cited by examiner

WRIST COVERING AND METHOD OF MAKING THE SAME

DESCRIPTION OF THE DISCLOSURE

1. Field of the Disclosure

The present application is directed to a covering for the wrist, and in particular, a covering that can be worn over a glove and coat sleeve to protect the wrist of the user from coming into contact with snow.

2. Background of the Disclosure

When a person is working or playing in winter conditions, snow can come into contact with the person's wrist between the gloves and coat sleeves, and frequently moves upward into the lower sleeve area of the coat and/or down into the gloves. This problem often occurs with children, who can have a difficult time removing the snow from their sleeves and gloves, thus causing their wrists and hands to become cold and wet.

Many attempts have been made to solve this problem. U.S. Pat. No. 4,856,112, to Effle, disclosed a powder cuff for preventing snow from penetrating between the glove and coat sleeve. The sleeve includes a snow impervious tubular portion adapted to cover the glove and coat sleeve of a user. The sleeve may extend from a position either below or above the elbow. A zipper may be used to more easily secure the sleeve over the coat sleeve and around the wrist of the user. Elastic bands, drawstrings or other fasteners are taught to bind the ends of the sleeve to the glove and coat at the wrist and proximate the elbow. A thumb loop can be used to help maintain the sleeve in position on the forearm of the user.

U.S. Pat. No. 6,449,772, to Donner, discloses a wrist cover having a generally cylindrical tubular member formed of fabric. The forward and rearward ends of the tubular member are elasticized to seal the ends to the arm and hand of the wearer. A thumb aperture is formed in the sidewall of the tubular member. Elastic bands encircle the aperture to form a seal around the thumb.

U.S. Pat. No. 6,092,235, to Santa Cruz et al., discloses a pair of weather proof wrist, forearm and elbow protectors, which extend from the wrist to the elbow of the user. The protectors include a thumb recess, which can be elasticized. An attachment means, such as an elastic band or drawstring, can be positioned on the palm section of the protector. Similarly, the wrist section can include an elastic band to provide a secure fit. A further attachment means, such as elastic, VELCRO®, or other means, may be included at the elbow section of the protector. The protectors include a closure means for closing an elongated opening running lengthwise on the protectors. The protectors can be made from, for example, insulated material such as POLYFILL®.

The above devices suffer from various drawbacks. For example, elastic used at the openings of a wrist covering can cause the device to be difficult to position with a single hand over bulky coats and/or gloves, and may cause the clothing underneath to uncomfortably bunch together or ride up the user's arm. Further, if the elastic is not properly fitted, it can become overly tight around the thumb, wrist or forearm and restrict venous return, thereby possibly causing cooling of the user's hands and fingers due to the resulting reduction in blood flow. Other fasteners employed in the above devices, such as zippers, snaps and draw strings, can be difficult to operate using a single gloved hand.

The thumb loop employed by the Effle device, discussed above, can cause undue risk of injury to the user. For example, if the Effle device were to be somehow forced up the arm during rigorous physical activity or while the user is participating in winter sports, the entire force would be transmitted by the thumb loop directly to the thumb. Such force could result in over-extension of the thumb and thereby cause injury to the metacarpo-phalangeal joint, ligament strain or other injury.

As described above, the devices taught by Donner and Santa Cruz fit over the palm of the hand and employ thumb apertures. The thumb aperture in the Donner device appears to fit relatively high up on the thumb (e.g., around the proximal phalanges or metacarpal-proximal phalages joint area), which may overly restrict the use of the thumb and interfere with the opposability of the thumb to the other four fingers. Further, devices that are insulated, such as Santa Cruz, or that do not fit conformally over the gloved palm, such as Donner, can provide excess material in the palm of the gloved hand, thereby causing discomfort and interference with the user's sensory perception and tactile recognition when grasping objects, as well as physical limitation in the very act of grasping with the hand or even with simple cupping of the hand.

Longer devices or devices that are insulated, such as taught by Santa Cruze and Effle, can be difficult to put on over the user's coat sleeve. In addition, these devices can overly interfere with the coat manufacturer's design of the coat sleeve for breathability, pliability, comfort and thermal insulation.

For the above reasons, improved wrist coverings are desired.

SUMMARY OF THE DISCLOSURE

In accordance with the disclosure, an embodiment of the present application is directed to a wrist covering designed to be worn over the gloved hand and arm-sleeve of a user. The wrist covering comprises a flexible, generally tubular member having a length extending from a first opening, designed to fit around a forearm of the user, to a second opening, designed to fit around the hand of the user. The first opening has a larger circumference than the second opening. The circumference of the tubular member continuously decreases from the first opening to the second opening. The wrist covering further includes a thumb aperture in the tubular member proximate to the second opening, the perimeter of the thumb aperture having a generally teardrop curve shape. A first hook and loop fastener is positioned on the tubular member in a manner that allows tightening of the tubular member around the user'hand. A second hook and loop fastener is positioned on the tubular member in a manner that allows tightening of the tubular member around the user's wrist. A third hook and loop fastener is positioned on the tubular member in a manner that allows tightening of the tubular member around the user's forearm.

Another embodiment of the present application is directed to a method of forming a wrist covering designed to be worn over the gloved hand and arm-sleeve of a user. The method comprises providing a generally trapezoidal shaped sheet of covering material having first and second sides, a base side and top side, wherein the base side is longer than the top side. A thumb aperture is formed in the material proximate the top side of the sheet. A first length of a first type of material is fixedly attached to a first side of the covering material. A second length of a second type of material is temporarily attached to the first length of material. The first side of the sheet is attached to the second side of the sheet while the second length is held in position by the first length, so that an end of the second length is fixedly attached to the covering material between the first and second sides.

Another embodiment of the present application is directed to a wrist covering designed to be worn over the gloved hand and arm-sleeve of a user. The wrist covering comprises a flexible, generally tubular member extending from a first opening, designed to fit around a forearm of the user, to a second opening, designed to fit around the hand of the user.

The first opening has a larger circumference than the second opening. The wrist covering further includes a thumb aperture in the tubular member proximate to the second opening. A first fastener is positioned on the tubular member in a manner that allows tightening of the tubular member around the user's hand. A second fastener is positioned on the tubular member in a manner that allows tightening of the tubular member around the user's wrist. A third fastener is positioned on the tubular member in a manner that allows tightening of the tubular member around the user's forearm.

Additional objects and advantages of the disclosure will be set forth in part in the description which follow, and can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate several embodiments of the disclosure and, together with the description, serve to explain the principles of the disclosure.

DESCRIPTION OF THE EMBODIMENTS

Reference will now be made in detail to various exemplary embodiments of the present application, examples of which are illustrated in the accompanying drawings. Wherever possible, the same reference numbers will be used throughout the drawings to refer to the same or like parts.

Figure 1:
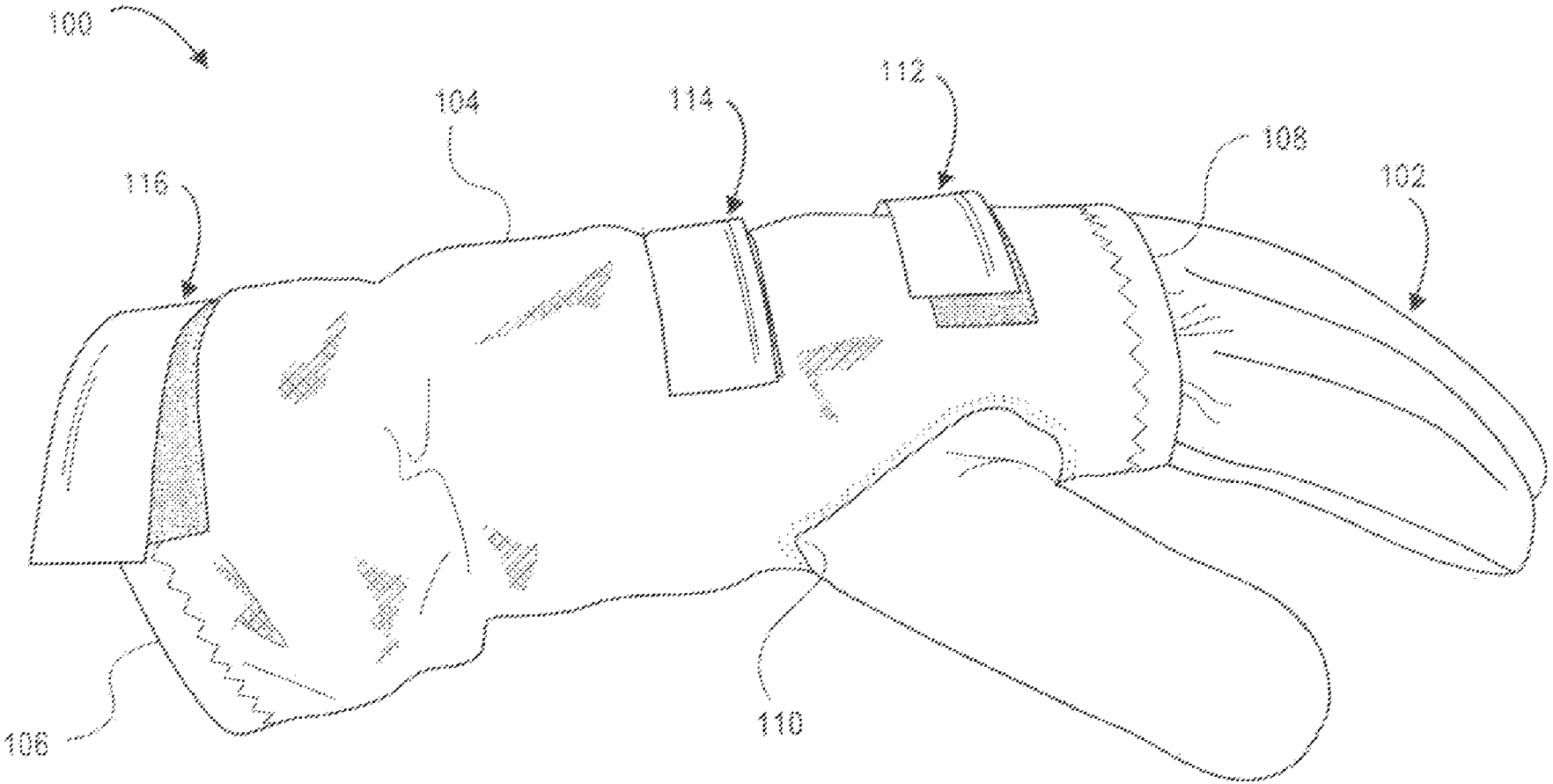
FIG. 1 illustrated a three-dimensional view of a wrist cover, according to an embodiment of the present application.

FIG. 1, illustrates a wrist cover 100 of the present application, also known as a WRIST-GATOR®. Wrist cover 100 is designed to be worn over a hand covering 102, such as a glove or mitten, and end of an arm sleeve (not shown), to provide protection of the user's wrist from snow.

Wrist cover 100 includes a flexible, generally tubular member 104 that is designed to cover the lower portion of a gloved hand, the wrist, and an end portion of the user's sleeve proximate the forearm of the user. Tubular member 104 includes an opening 106, designed to fit around the sleeve covered forearm of the user, and an opening 108, designed to fit around the gloved palm and back of the hand of the user. In an embodiment, opening 106 has a larger circumference than opening 108. In an embodiment, the circumference of tubular member 104 continuously decreases from opening 106 to opening 108 when the sleeve member is extended to the full circumference of the material, in order to allow a more conformal fit. Tubular member 104 is designed to fit the user so that it does not extend above the elbow. In some embodiments, tubular member 104 has a length chosen to allow it to extend from the palm of the user to some point along the forearm between the wrist and the elbow. For example, the length of tubular member 104, between openings 106 and 108, may range from about 5 inches to about 12 inches, or in some embodiments, from about 8 inches to about 10 inches. In an embodiment, the tubular member does not include elastic proximate openings 106 and 108.

Tubular member 104 can be made of any suitable material. In some embodiments, the material is water-resistant and/or breathable. Examples of suitable material include water-resistant nylon and materials comprising a porous fluoropolymer membrane, such as GORE-TEX®, which is available from W.L. Gore & Associates, although any other suitable material can be employed. In some embodiments, it may be desirable to employ an abrasion resistant material and/or nonslip material, such as leather or other textured surface, over the palm area to provide for improved durability and/or better gripping. In some embodiments, the material of tubular member 104 may be reinforced by employing additional material and/or wear resistant types of material around the openings 106 and 108, at the seams or around a thumb aperture 110, to reduce the risk of tearing and provide durability, as is well known in the art. In an embodiment, the tubular member comprises an unlined, single sheet of material that is seamed at the first and second openings.

Figure 2:
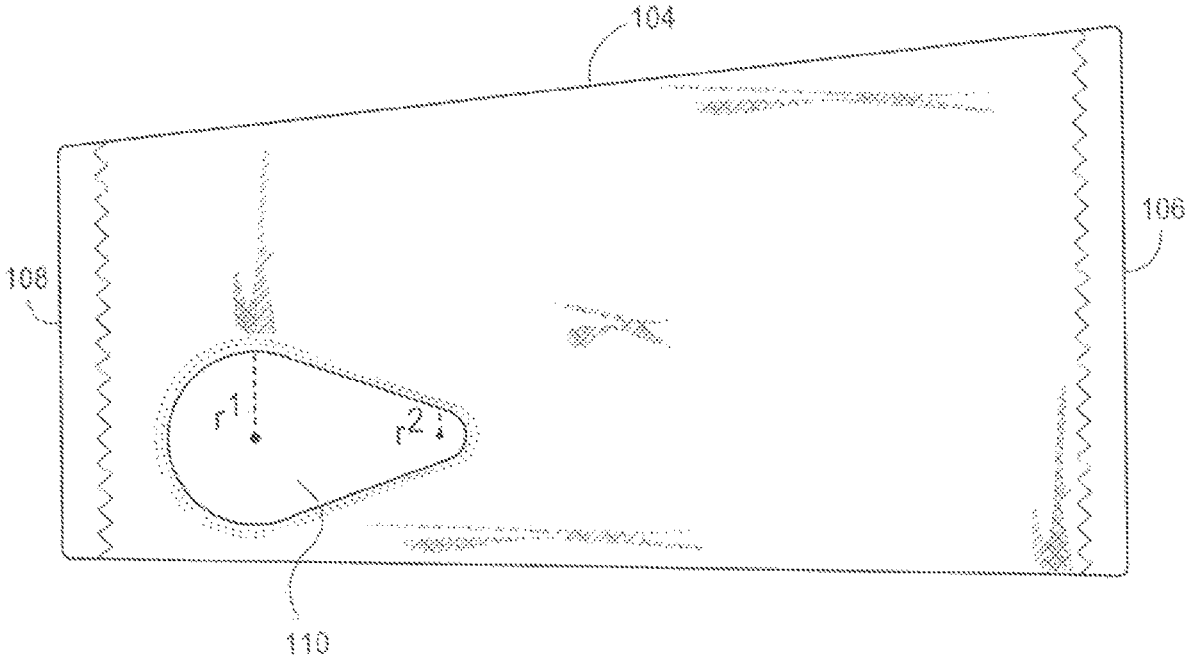
FIGS. 2 and 3 illustrate side views of a wrist cover, according to an embodiment of the present application.

As shown in FIG. 2, the thumb aperture 110 is positioned proximate to end 108. Thumb aperture 110 can have any desired shape, such as, circular or oval. In one embodiment, thumb aperture 110 has a generally teardrop curve shape. The generally teardrop curve shape may be an oblong opening that is curved at two opposite ends, the radius of curvature, $r_1$, at the first end being larger than the radius of curvature, $r_2$, at the second end. It has been found that a thumbhole having this teardrop shaped curve fits more conformally around the natural shape of the base of the thumb and thenar eminence portion of the gloved palm than, for example, oval or circular shaped apertures. Apertures that have oval or circular shapes may tend to flare outward, as opposed to conforming relatively flatly against the glove. While oval and circular holes can be used in devices of the present application, such flaring may undesirable allow for an increased influx of snow through the thumb aperture, provide a poor aesthetic appearance, and may also increase the risk of the thumb aperture snagging on objects during use.

A teardrop shaped thumb aperture 110 can also be designed to be relatively large, while still providing a conformal fit. For example, aperture 110 can be designed to fit around the thumb so that the large radius portion of the teardrop shape lies against the user's glove between the thumb and index finger, and the small radius portion extends down around the base of the metacarpal of the gloved thumb, proximate the wrist, similarly as shown in FIG. 1. Thumb aperture 110 can be large enough to accommodate at least a portion of the glove covering the user's thenar eminence. This relatively large thumb aperture is designed to be comfortable to the user while not significantly interfering with the range of motion of the thumb, including thumb opposition to the tips of fingers 2 to 5. In addition, because the relatively large thumb aperture will fit a wide range of hand sizes, it provides for a one-size-fits-all design. In an embodiment, tubular member 104 does not comprise elastic proximate the thumb aperture.

Figure 3:
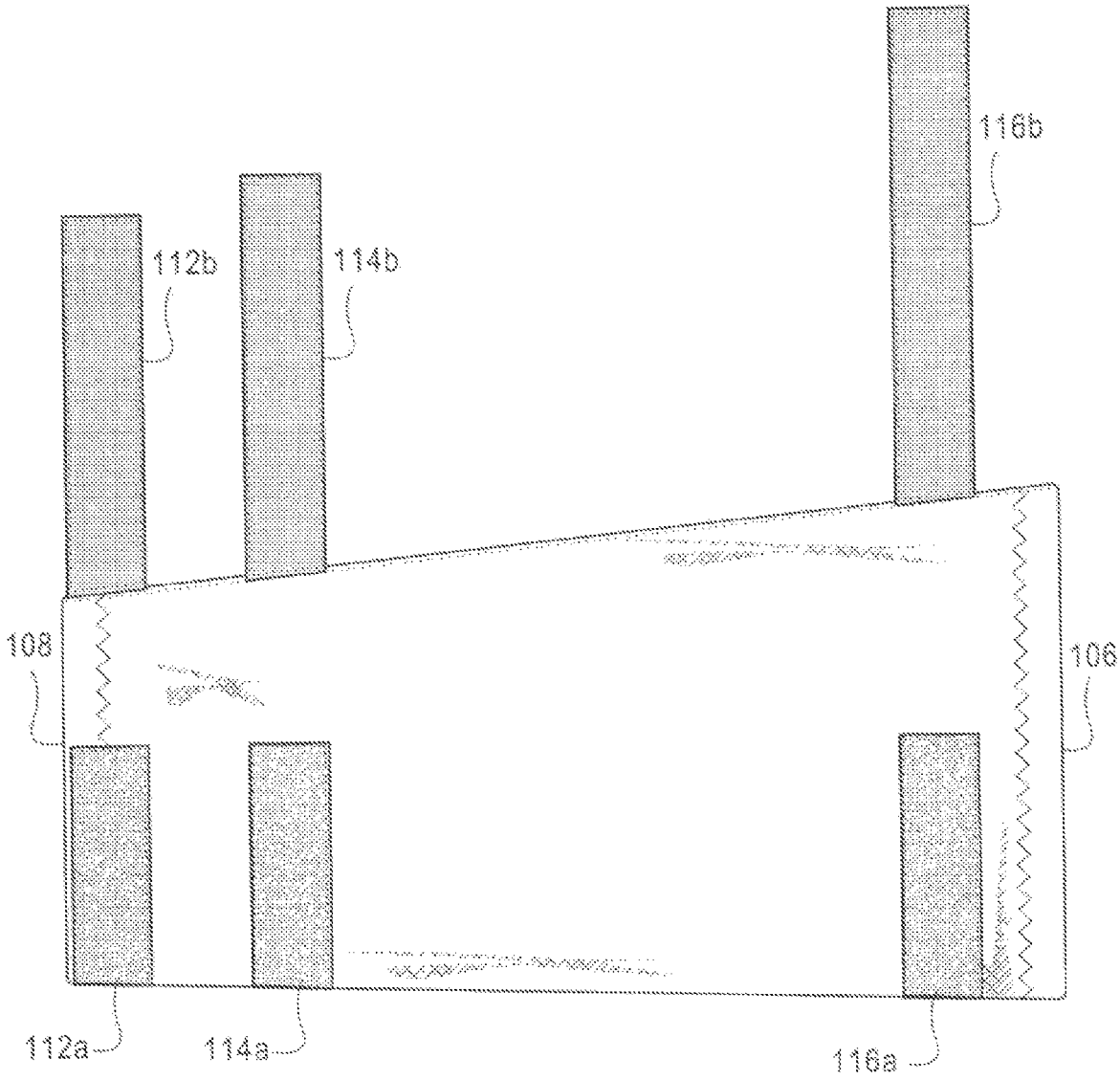

As shown in FIGS. 1 and 3, a first hook and loop fastener 112 is positioned on the tubular member in a manner that allows tightening of the tubular member around the user's palm, proximate opening 108. Fastener 112 allows the user to adjust the tubular member proximate the palm area of the hand so that it lies flat in the palm against the glove. This can be desirable, as loose material in the palm can bunch up and interfere with tactile and sensory perception of the user's hand, as well as interfere with the very act of gripping itself. Strap 112 functions with thumb aperture 110 to provide a secondary snow barrier around the thumb, as well as around the palm, as the tubular member proximate thumb aperture 110 and opening 108 is constricted so as to lie conformally against the user's palm of the gloved hand. In an embodiment, strap 112 can be positioned on the tubular member 104 so that a longitudinal centerline (not shown) of the strap 112 crosses a boundary line of the thumb aperture 110.

A second hook and loop fastener 114 is positioned on the tubular member in a manner that allows tightening of tubular member 104 around the user's wrist, proximate the portion of the thumb aperture 110 near the base of the hand. Fastener 114 functions to provide a barrier to snow by constricting the tubular member at the user's writs area and by helping to pull the material at the base of thumb aperture 110 flat against the user's glove. A third hook and loop fastener is positioned on the tubular member in a manner that allows tightening of the tubular member around the user's forearm, proximate opening 106. Fastener 116 functions to provide a barrier to snow by constricting tubular member 104 at the user's forearm. Further, it is thought that fasteners 114 and 116 may function together to help keep the user's glove and sleeve in proper position during use, thereby possibly providing further snow protection by tending to resist separation of the glove from the sleeve.

Figure 4A:
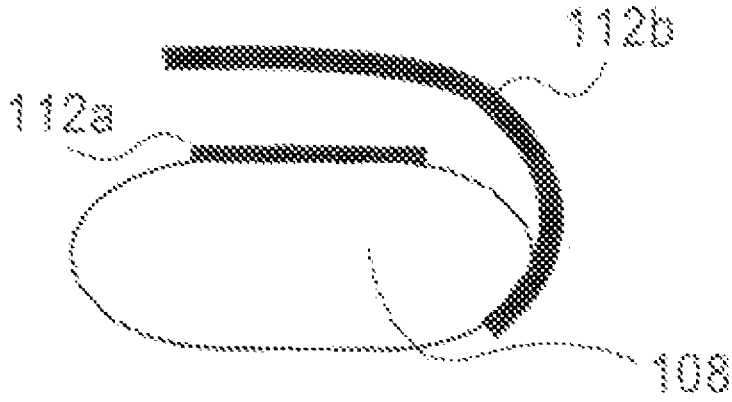
FIGS. 4A and 4B illustrate a fastening means for a wrist cover, according to an embodiment of the present application.
Figure 4B:
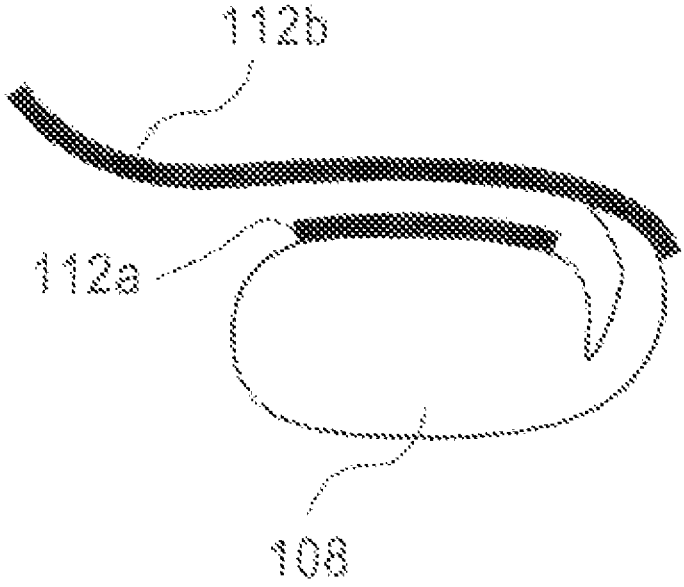

Any suitable hook and loop fastener design that will function to tighten the opening can be employed for fasteners 112, 114 and 116. In an embodiment of FIG. 3, lengths of hook type material 112*a*, 114*a*, 116*a* are fixedly attached to the tubular member so as to be positioned on the back of the hand, wrist and forearm of the user. Straps 112*b*, 114*b* and 116*b* can be attached to the tubular member so as to be positioned on one side (e.g., the ulnar side) of the hand, wrist and forearm of the user. In this embodiment, at least a portion of straps 112*b*, 114*b* and 116*b* is loop type material. When straps 112*b*, 114*b* and 116*b* are attached to the respective lengths of hook material 112*a*, 114*a* and 116*a*, tubular member 104 tightens around the user's hand, wrist and forearm, in a manner such as is shown in FIGS. 4A and 4B. In another embodiment, the length of material used for 112*a*, 114*a* and 116*a* can be loop material and the straps 112*b*, 114*b* and 116*b* can include a hook type material. Other hook and loop fastener designs can be employed. For example, a single strap that includes both hook type and loop type material can be used in conjunction with a ring or loop fastened to the tubular member, as is well known in the art. The strap can be threaded through the ring or loop and doubled back on itself so that the hook and loop material on the strap engages, thus constricting the tubular member.

While hook and loop fasteners are thought to provide the advantage of being easier to fasten with a single gloved hand than other types of fasteners, it is also within the scope of the present application to employ other suitable fasteners that are easy to fasten with a single gloved hand, in addition to or in place of the hook and loop fasteners. For example, cinch straps or cinch cords and the like, could be used.

Any suitable method for making the wrist coverings of the present application may be employed. One suitable example of a method for making the wrist covering will now be described with reference to FIGS. 5A to 5D.

Figure 5A:
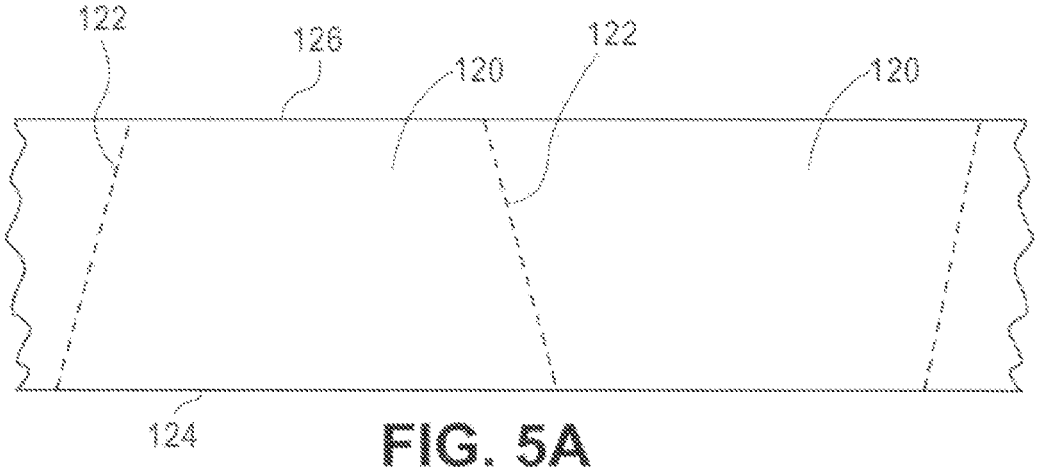
FIGS. 5A to 5D illustrate a method of making a wrist cover, according to an embodiment of the present application.

As shown in FIG. 5A, generally trapezoidal shaped sheets 120 can be cut from a length of suitable material. The sheets include sides 122, base 124 and a top side 126 that is shorter than base 124. In some embodiments, the length of top side 126 can be at least about 1 inch shorter than base 124, such as about 2 to about 5 inches shorter; thus resulting in a circumference of opening 108 in the finished wrist cover that is at least about 1 inch shorter than opening 106, such as about 2 to about 5 inches shorter. The relative sizes taught for the base and top side are exemplary only, and any suitable dimensions may be employed for sheet 120. As shown in FIG. 5A, this trapezoidal shape can allow multiple sheets 120 to efficiently be cut from the same cloth with little or no waste of material, as a single cut along a side 120 can form the sides of two adjacent trapezoidal sheet patterns positioned inversely to each other along a single length of material.

Figure 5B:
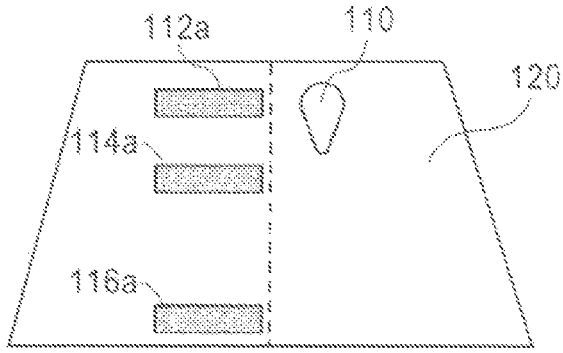

A thumb aperture 110 is then formed by any suitable method, as shown in FIG. 5B. In one embodiment, thumb aperture 110 can be cut using an instrument that is heated to above the melting temperature of the covering material, which is believed to fuse the fibers of the material proximate the perimeter of the aperture.

Fastener portions 112*a*, 114*a* and 116*a*, as discussed above, can then be fixedly attached to sheet 120 in the desired positions using any suitable method, such as stitching or use of an adhesive. In embodiments, as discussed above, fastener portions 112*a*, 114*a* and 116*a* can include a length of either hook or loop type material.

Figure 5C:
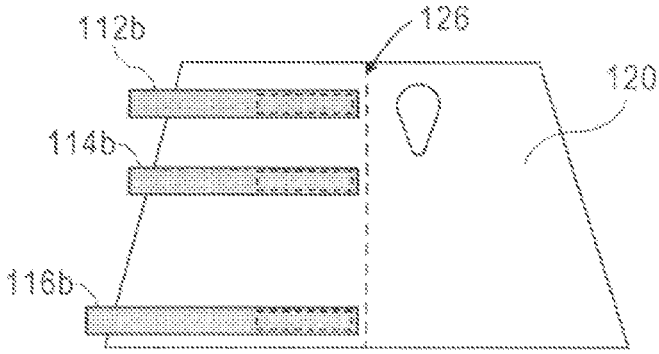

The mated strap portions 112*b*, 114*b* and 116*b* can then be temporarily attached by engaging a desired length of the opposite type of material to fixedly attached portions 112*a*, 114*a* and 116*a*, respectively, as illustrated in FIG. 5C. Thus, for example, where the fastener portions 112*a*, 114*a* and 116*a* are hook type material, the mated strap portions 112*b*, 114*b* and 116*b* are loop type material, and vice versa.

Figure 5D:
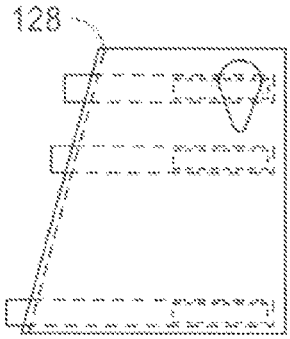

Sheet 120 can then be folded proximate a central axis 126 and the two sides 122 attached along a desired position 128 by any suitable method, such as by stitching or use of an adhesive. In this manner, end portions of the straps 112*b*, 114*b* and 116*b*, which are temporarily held in place by portions 112*a*, 114*a* and 116*a* so as to extend through the position 128, can be simultaneously attached to sheet 120 when sides 122 are attached, as shown in FIG. 5D. The ends of straps 112*b*, 114*b* and 116*b* can then be trimmed if desired. At this point, sheet 120, with the sides 122 attached, forms a tubular member that can be turned right-side out to form a wrist cover, as illustrated in FIG. 1.

The above described exemplary method provides an efficient and cost-effective process for forming the wrist coverings of the present application. However, given the teachings of the present application, one of ordinary skill in the art would readily contemplate other suitable methods for forming the wrist coverings, which would fall within the scope of the present application.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a", "an" and "the" include plural referents unless expressly and unequivocally limited to one referent. Thus, for example, reference to "an acid" includes two or more different acids. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements and substantial equivalents that are or can be presently unforeseen can arise to applicants or others skilled in the art. Accordingly, the appended claims as filed and as they can be amended are intended to embrace all such alternatives, modifications, variations, improvements and substantial equivalents.

What is claimed is:

1. A wrist covering designed to be worn over the gloved hand and arm-sleeve of a user, the wrist covering comprising:

a sleeve member comprising a sheet of material having first and second sides, a base side and top side, wherein the base side is longer than the top side, the first and second sides of the sheet being fixedly held together with an attachment mechanism that extends along substantially the entire first and second sides to form the sleeve member, the sleeve member having a length extending from a first opening, designed to fit around the forearm of the user, to a second opening, designed to fit around the hand of the user, the first opening having a larger circumference than the second opening, and wherein the circumference of the sleeve member continuously decreases from the first opening to the second opening when the sleeve member is extended to the full circumference of the material;

a thumb aperture in the sleeve member proximate to the second opening;

a first fastener positioned on the sleeve member so that a longitudinal centerline of the first fastener crosses a boundary line of the thumb aperture, the first fastener being different from the attachment mechanism and being capable of providing for increased tightness of the sleeve member around the user's hand relative to the tightness that would be achieved by employing the attachment mechanism without the first fastener; and a second fastener positioned on the sleeve member, the second fastener being different from the attachment mechanism and being capable of providing increased tightness of the sleeve member around the user's forearm relative to the tightness that would be achieved by employing the attachment mechanism without the second fastener, wherein the first and second fasteners are chosen from straps and cinch cords.

2. The wrist covering of claim 1, wherein the sleeve member does not comprise elastic proximate the first opening.

3. The wrist covering of claim 1, wherein the sleeve member does not comprise elastic proximate the thumb aperture.

4. The wrist covering of claim 1, wherein the sleeve member is an unlined, single sheet of the material, the material being water resistant.

5. The wrist covering of claim 4, wherein the material comprises at least one material chosen from nylon and a porous fluoropolymer membrane.

6. The wrist covering of claim 4, wherein the attachment mechanism is stitching.

7. The wrist covering of claim 6, wherein the first and second fasteners are hook and loop fasteners.

8. The wrist covering of claim 7, wherein a third hook and loop fastener is positioned on the sleeve member in a manner that allows tightening of the sleeve member around the user's wrist.

9. The wrist covering of claim 1, wherein the length of the sleeve member ranges from about 5 inches to about 12 inches.

10. A method of making a wrist covering designed to be worn over the gloved hand and arm-sleeve of a user, the method comprising:

providing a generally trapezoidal shaped sheet of covering material having first and second sides, a base side and top side, wherein the base side is longer than the top side;

forming a thumb aperture in the material proximate the top side of the sheet;

fixedly attaching a first length of a first type of material to a first side of the covering material;

temporarily attaching a second length of a second type of material to the first length of material, wherein the first type of material and the second type of material are chosen from mating portions of hook and loop material; and stitching the first and second sides of the sheet together while the second length is held in position by the first length so that an end of the second length is stitched to the covering material between the first and second sides in a manner that allows the second length of material to be fixedly attached to the sheet by the stitching when the second length is not attached to the first length.

11. The method of claim 10, wherein the covering material is water-resistant.

12. The method of claim 10, wherein the first length is hook type material and the second length is loop type material.

13. The method of claim 10, wherein the first length is loop type material and the second length is hook type material.

14. A wrist covering designed to be worn over the gloved hand and arm-sleeve of a user, the wrist covering comprising:

a sleeve member comprising a sheet of material having first and second sides, a base side and top side, wherein the base side is longer than the top side, the first and second sides of the sheet being stitched together along the entire first and second sides to form the sleeve member, the sleeve member having a length extending from a first opening, designed to fit around the forearm of the user, to a second opening, designed to fit around the hand of the user, the first opening having a larger circumference than the second opening, and wherein the circumference of the sleeve member continuously decreases from the first opening to the second opening when the sleeve member is extended to the full circumference of the material, the sleeve member being unlined and having a length ranging from about 5 inches to about 10 inches;

a thumb aperture in the sleeve member proximate to the second opening, the thumb aperture having a generally teardrop curve shape;

a hook and loop first fastener positioned on the sleeve member so that a longitudinal centerline of the first fastener crosses a boundary line of the thumb aperture, the first fastener being capable of providing for increased tightness of the sleeve member around the user's hand relative to the tightness that would be achieved without the first fastener; and a hook and loop second fastener positioned on the sleeve member, the second fastener being capable of providing increased tightness of the sleeve member around the user's forearm relative to the tightness that would be achieved without the second fastener.

* * * * *